United States Patent [19]

Fekete et al.

[11] 4,223,472

[45] Sep. 23, 1980

[54] TOY PROJECTILE LAUNCHING DEVICE

[75] Inventors: Ferenc Fekete, Huntington Beach; Wayne R. Halford, Manhattan Beach, both of Calif.; Michael O. Hirtle, East Aurora, N.Y.

[73] Assignee: Mattel, Inc., Hawthorne, Calif.

[21] Appl. No.: 899,374

[22] Filed: Apr. 24, 1978

[51] Int. Cl.[3] ..... A63H 29/16

[52] U.S. Cl. ..... 46/44; 46/74 B; 124/70

[58] Field of Search ..... 46/74, 74 A, 74 B, 74 C, 46/76 A, 44; 124/70, 71, 73, 76, 69; 272/4

[56] References Cited

U.S. PATENT DOCUMENTS

| | | | |
|---|---|---|---|
| 1,260,013 | 3/1918 | Neats | 46/44 X |
| 2,675,642 | 4/1954 | Coleman et al. | 46/86 A |
| 2,733,699 | 2/1956 | Krinsky | 46/74 X |
| 2,991,589 | 7/1961 | Ayla | 46/174 |
| 2,993,297 | 7/1961 | Bednar et al. | 46/74 |
| 3,003,490 | 10/1961 | Deterding et al. | 46/74 |
| 3,025,633 | 3/1962 | Kaye et al. | 46/74 B |
| 3,046,694 | 7/1962 | Holderer | 46/74 |
| 3,121,292 | 2/1964 | Butler et al. | 46/74 |
| 3,191,342 | 6/1965 | Chambers | 46/74 |
| 3,368,301 | 2/1968 | Kinberg | 46/74 |
| 3,739,764 | 6/1973 | Allport | 46/74 B |
| 4,149,338 | 4/1979 | Wolf | 46/44 |

*Primary Examiner*—Robert Peshock
*Assistant Examiner*—Mickey Yu
*Attorney, Agent, or Firm*—John G. Mesaros; Max E. Shirk; Ronald M. Goldman

[57] ABSTRACT

A toy projectile launching device having a main tubular member in fluid communication with an air pump, an air storage tank and a projectile launching housing rotatably coupled to the main tubular member. A valve member manually operable within the main tubular member, and with the valve member in a first position air from the air pump passes into the air storage tank; in a second position of the valve member, the pressurized air within the tank is released to propel a projectile within the housing. A third position of the valve member permits air from the air tank to be released in minute quantities to actuate an air-operated sounding device.

14 Claims, 5 Drawing Figures

TOY PROJECTILE LAUNCHING DEVICE

BACKGROUND OF THE INVENTION

The background of the invention will be discussed in two parts:

Field of the Invention

This invention relates to toy projectile launching devices, and more particularly to a toy rocket launching device.

Description of the Prior Art

Toys using air as a means for propelling a projectile provide a constant source of amusement to children. One such toy in the form of a rocket launcher is shown and described in U.S. Pat. No. 2,733,699 in which the launching device includes an air pressure chamber having an air pump adapted for introducing compressed air into the chamber, the compressed air subsequently being utilized for launching the rocket. For controlling the direction of launch, the entire housing may be tilted.

Other such air operated devices are shown and described in U.S. Pat. Nos. 2,993,297; 3,003,490; and 3,739,764, by way of example. Such prior art air operated projectile launchers have taken various forms of simplicity or complexity.

It is an object of the present invention to provide a new and improved toy projectile launching device.

It is another object of the present invention to provide a new and improved toy rocket launcher simulating a missile launching site.

It is a further object of this invention to provide a toy rocket launcher having an air storage tank with a pressure gauge.

It is still another object of this invention to provide a toy rocket launcher having an air-operated sounding device to simulate a countdown.

SUMMARY OF THE INVENTION

The foregoing and other objects are accomplished by providing a toy projectile launching apparatus having a main tubular member secured to a base and further having an air pump, an air storage tank, and a rocket launching housing in fluid communication with the main tubular member. An elongate bar member is positioned within the main tubular member, the bar member having enlarged valve ends at opposite ends thereof in sliding sealing relation within the tubular member. The valve member is manually operable to first, second and third positions, the first position permitting the transfer of air from the air pump to the air storage tank; the second position permitting the passage of the compressed air from the air storage tank to the rocket launching housing; and the third position of the valve member permitting the escape of minute quantities of air from the air storage tank through an air-operated sounding mechanism. The air storage tank is provided at the upper end thereof with an enlarged opening having a collar portion configured for receiving a diaphragm member of rubber or the like, the expansion of the diaphragm under the force of the compressed air entering the air storage tank, actuating a gauge mechanism in physical contact with the diaphragm to indicate the amount of air pressure within the tank.

The rocket launching end of the apparatus is rotatably coupled to the main tubular member to vary the angle of launch and an inclinometer is coupled to the rocket launching housing to provide a visual indication of the angle of launch.

Other objects, features and advantages of the invention will become apparent from a reading of the specifications when taken in conjunction with the drawings in which like reference numerals refer to like elements in the several views.

DESCRIPTION OF THE PREFERRED EMBODIMENT

Figures 1, 2, 3, 4:
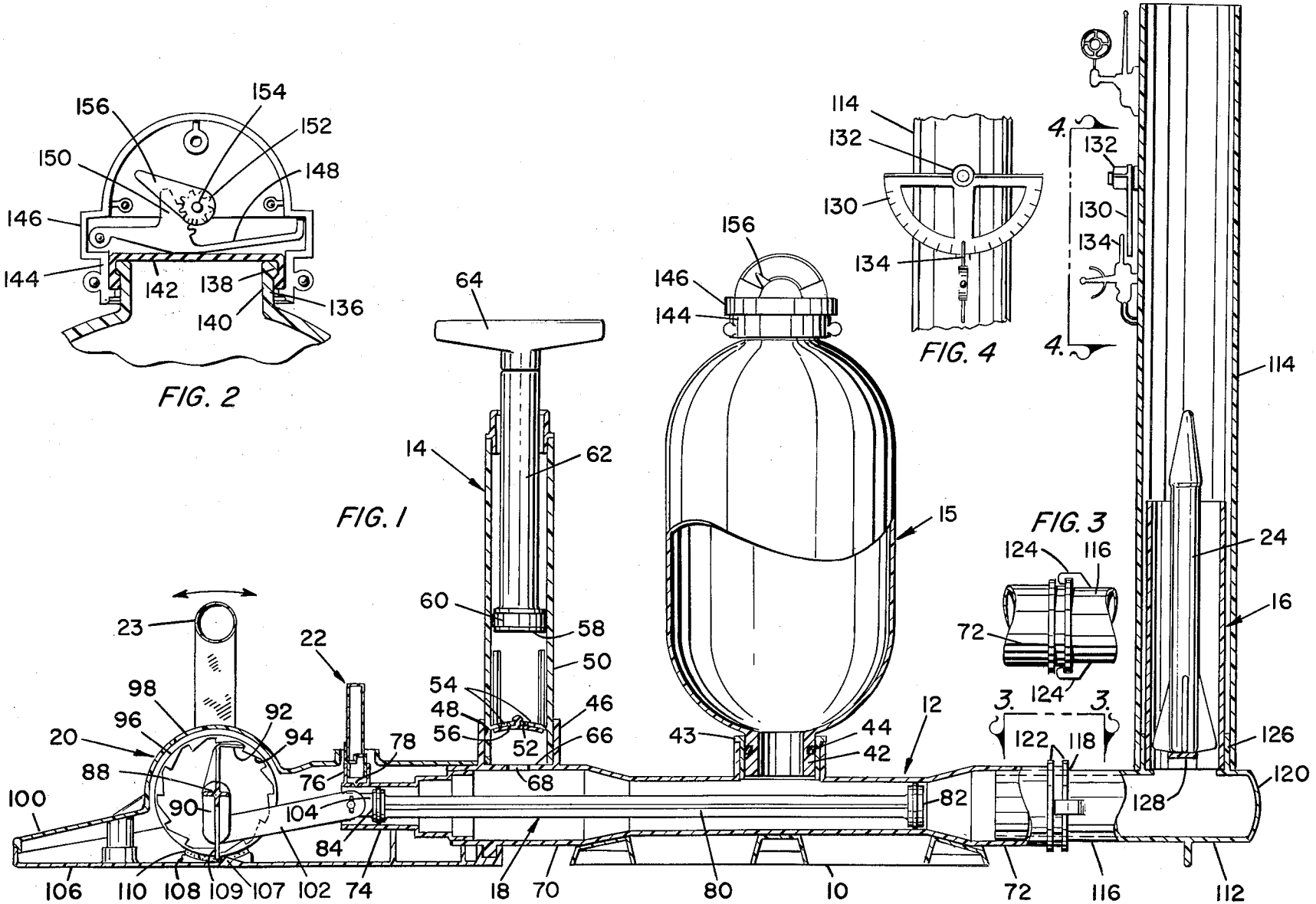
FIG. 1 is a side elevational view, partially in cross section and partially broken away, of the toy projectile launching device according to the invention.
FIG. 2 is an enlarged cross sectional view showing the air pressure gauge and safety valve used in the device of FIG. 1.
FIG. 3 is a plan view of a coupling portion of the device of FIG. 1 as viewed generally along line 3—3.
FIG. 4 is a side elevational view of a portion of the gantry of the device of FIG. 1 as viewed generally along line 4—4 thereof.

Referring now to the drawings and particularly to FIG. 1 there is shown a toy projectile launching apparatus which includes a base member 10 having secured thereto a main tubular member generally designated 12 with the main tubular member 12 having secured thereto in fluid communication therewith an air pump generally designated 14, a suitable air storage means such as a tank generally designated 15 and a projectile or rocket launching housing generally designated 16. Positioned within the main tubular member 10 are suitable valve means generally designated 18 manually operated by a countdown mechanism generally designated 20. An air-operated whistle or the like 22 is also in fluid communication with the main tubular member 12 to permit the operator to selectively pass air therethrough in response to operation of the handle 23 of the countdown mechanism 20 for emitting audible signals indicative of a countdown. A suitable projectile such as a rocket 24 is positioned within the rocket launching housing 16 for propulsion as will hereinafter be described in detail.

Figure 5:
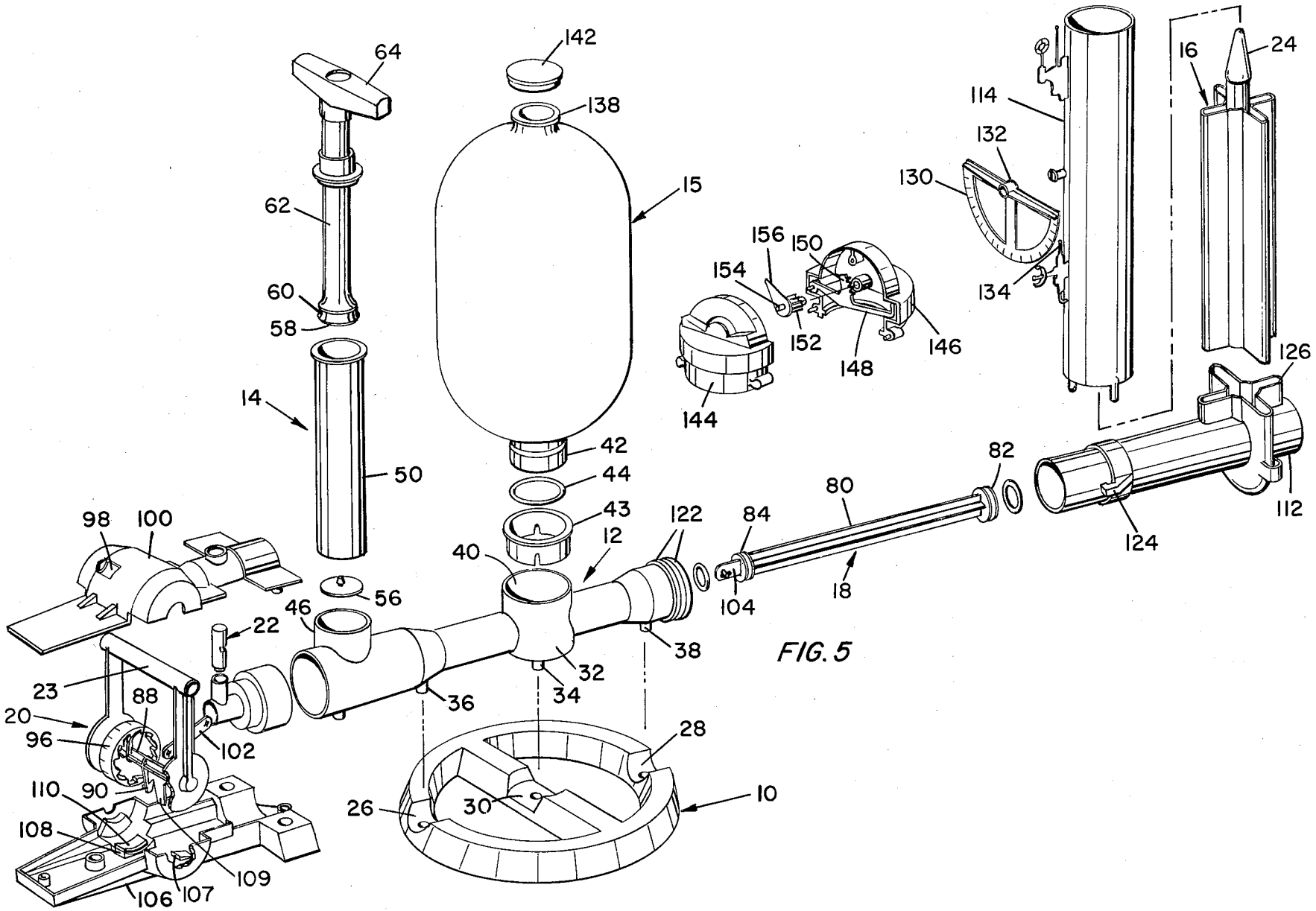
FIG. 5 is an exploded perspective view of the device of FIG. 1.

Referring now specifically to FIGS. 1 and 5, the base 10 is generally circular in plan view and is provided with arcuately shaped recesses 26 and 28 and a central recess 30. The tubular member 12 is provided with a centrally disposed cup-shaped portion 32 having a depending projection 34 configured for engaging a mating aperture within recess 30, with recesses 26 and 28 of base 10 being configured for receiving projections 36 and 38 respectively formed in the underside of the tubular member 12, the projections 36 and 38 fitting into suitable apertures within recesses 26 and 28. The connection of the tubular member 12 to the base 10 may be accomplished by any convenient method such as welding, or just friction.

The cup-shaped portion 32 of main tubular member 12 has an open end 40 which is circular in cross section and has secured therein a sleeve connection 43 into which is inserted the neck portion 42 of the storage tank 15, the connection being effected with a suitable O ring 44 which provides a seal between the inner wall of opening 40 and the other surface of neck 42 of air tank 15.

Also integrally formed with the tubular member 12 is a second cup-shaped portion 46 having an open end 48 of circular cross section for receiving therein the barrel 50 of the air pump means 14. The air pump 14 includes the barrel 50 which is provided at the lower end thereof with a recessed web portion 52 having a pair of apertures 54 formed therein with a central aperture receiving a projection from a rubber diaphragm member 56 on the outer surface thereof. Positioned within barrel 50 is a piston 58 having a suitable rubber seal 60 about the periphery thereof. The piston 58 is integral with a rod portion 62 terminating externally of the barrel 50 and having secured thereto a suitable handle 64 for actuating the piston 58. The cup-shaped portion 46 of the tubular member 12 has a bottom 66 with a centrally disposed aperture 68 passing therethrough. Upon depression of the handle 64 downwardly, air within the barrel 50 passes out through the apertures 54 through the aperture 68 through tubular member 12 through the opening of the neck portion 42 into the air storage tank 15. As the piston 58 is withdrawn, the rubber diaphragm 56 urges against the apertures 54 to retain the air within the air storage tank. The pump 14 may be of any conventional configuration.

The main tubular member 12 has a reduced diameter portion in proximity to the opening of the air storage tank 15, with the opposite ends being flared outwardly to form enlarged diameter portions 70 and 72, the enlarged diameter portion 70 having the cup-shaped portion 46 formed therein for receiving the air pump 14. The main tubular member 12 is then necked down by an insert member 74 of circular cross section, the insert 74 being inserted in airtight relation within the enlarged diameter portion 70. The insert 74 may be formed integrally with the main tubular member 12. The free end of the insert member 74 is provided with a cup-shaped recess 76 into which is inserted the air sounding means or whistle 22, the recess 76 having an aperture 78 in the bottom thereof for communicating with the interior of the insert 74.

Suitable valve means 18 are positioned within the main tubular member 12 and insert 74, the valve means 18 including an elongate bar shaped portion or rod 80 having the opposite ends thereof configured to form valve portions 82 and 84 respectively, thus providing a double ended valve rod. Each of the valve portions 82 and 84 is provided with an O-ring about the periphery thereof to provide a sealing sliding relation within the tubular member 12, and the insert member 74. The elongate rod 80 of the valve means 18 extends on the axis of the tubular member 12 and is of such a length, that in the first position of the valve means 18 as shown in solid lines in FIG. 1, the valve member 82 is within the reduced diameter portion of the tubular member 12 adjacent the enlarged diameter portion 72 thereof, while the valve member 84 is adjacent to and to the right of the aperture 78 through which air passes to operate the whistle 22. In this position, opposite ends of the tubular member are effectively sealed to permit air from the air pump means 14 to pass through the tubular member 12 into the air storage tank 15 to provide a source of compressed air.

Operation of the valve means 18 is effected by means of the handle 23 of the countdown mechanism 20 which pivots a shaft 88 having a first lever 90 extending radially therefrom and a second pawl lever 92 extending radially therefrom in the opposite direction. The pawl lever 92 engages the inner ratcheted surface 94 of a countdown wheel 96 which has indicia printed on the face thereof for viewing through a window 98 of the upper housing 100 of the countdown mechanism 20. The end of the first lever 90 is pivotally coupled to an interconnecting linkage 102 which has the other end thereof connected pivotally to a projection 104 extending outwardly from valve member 84 of the valve means 18. The lower housing 106 of the countdown mechanism 20 has an arcuately contoured portion 108 which has a friction pad 110 secured thereto for abutting against the surface of the countdown wheel 96.

The lower housing 106 is also provided with an upwardly extending ramp portion 107 disposed forwardly of a downwardly depending tongue 109 which is an integrally formed part of shaft 88 extending downwardly for engagement with the leading edge of ramp 107 with the handle 23 extending generally vertically. The tongue 109 which is generally resilient and in coaction with ramp 107 operates as limiting means during the countdown. During this countdown, the handle 23 is urged forwardly (that is toward pump 14) and with the pawl of lever engaging a detent 94, the countdown wheel 96 is rotated clockwise as viewed in FIG. 1. The countdown wheel 96 is independently rotatably coupled to shaft 88 with the first and second levers 90 and 92 being integrally formed with the shaft 88. During this forward movement of handle 23 the linkage 102 pulls the double ended valve rod 80 to the left until valve member 84 passes aperture 78 associated with the air operated sounding means or whistle, thereby emitting an audible blast, the duration of which is determined by the length of time the handle 23 is kept in this position.

As the handle 23 is then rotated rearwardly or counterclockwise, the friction pad 110 urging against the periphery of countdown wheel 96 retains countdown wheel 96 in position with the pole end of lever 92 sliding over a ratchet tooth or detent 94 until the pole end detents with the next tooth. Also during this rearward movement, the tongue 109 has the lower tip thereof urging against ramp 107 to limit rearward movement of handle 23 until an additional increment of force is applied to operate handle 23 against the resilience of tongue 109 urging against ramp 107, this position corresponding to the launch position as will hereinafter be described.

The rocket launching end of the apparatus includes the silo or rocket launching housing 16 and an elbow member 112 as well as a simulated gentry 114. The elbow member has a generally tubular portion 116 with an open end 118 and a closed end 120, the diameter of tubular portion 116 being generally equal to the enlarged diameter portion 72 of the main tubular member 12. The open end of the enlarged diameter portion 72 is provided with a pair of spaced flanges 122 with the open end 118 of tubular portion 116 having a pair of diametrically opposed hook-shaped clamp members 124 configured for engaging one of the flanges 122 for rotatably coupling the tubular portion 116 to the enlarged diameter portion 72 of main tubular member 12 to vary the angle of launch of rocket 24. The tubular portion 116 is provided with a generally perpendicular upwardly extending wall portion 126 configured in the form of a cruciform with the rocket launching housing 16 being matingly configured with the opening therein generally conforming to the cross sectional silhouette of the finned portion of the rocket 24, this configuration providing optimum or maximum transfer of the compressed air to the launching end of the rocket 24 to provide maximum thrust. Formed integrally within the launching housing 16 and generally centrally relative to the wall portion 126, is a rocket pad portion 128 upon which the rocket 24 rests prior to launching. Encircling the wall portion 126 is a simulated gantry 114 having affixed to the exterior thereof an elevation indicator or inclinometer formed from a protractor member 130 pivotally secured to the gantry 114 at pivot 132 with a stationary pointer 134 affixed to the exterior of the gantry 114. As the elbow member 112 is rotated relative to the flanges 122 of the main tubular member 12, the force of gravity tends to maintain the protractor member 130 level thereby providing an indication of the angle of launch of the rocket 24.

The rocket 24 is formed of a suitable foam composition with the fins being integral therewith, the fins being in close spaced relation within the opening of the rocket launching housing 16, and with the rocket 24 resting on the pad 128 as shown in FIG. 1, the rocket is ready for launching. Air from the air pump 14, with the valve means 18 in the solid line position in FIG. 1 passes into the air storage tank 15 where it is compressed. As the handle 23 is manipulated forwardly and rearwardly, the indicia of the countdown wheel 96 appears in the window 98 in decreasing numerical order and for each increment, the valve member 84 passes the aperture 78 to emit a blast from the air operated whistle 22. The launch can be effected at any time by rotating the handle 23 rearwardly a greater amount to thereby pass valve member 82 into the enlarged diameter portion 72 of the main tubular member 12 whereupon the compressed air from the air storage tank 15 passes out around the periphery of the valve member 82 into the elbow member 112 to urge against the fins of rocket 24 to thereby launch the same.

In order to provide an indication of the amount of air entering the air storage tank 15, the upper end of tank 15 is provided with a collar portion 136 having a rim portion 138 and an open end 140. Encircling the rim 138 is a rubber membrane 142 secured in placed by a collar portion 144 of a pressure gauge housing 146. Pivotally mounted within the housing 146 is an arm member 148 pivoted at one end thereof and having an intermediate upwardly extending rack portion 150 engaging the pinion 152 of a shaft 154 having affixed thereto a needle or pointer 156. A segment of the housing 146 is removed to make the pointer 156 visible, and as the air within the tank 15 increases, the pressure from within the tank 15 urges against the membrane 142 to pivot the arm 148 about its pivot point (counterclockwise as viewed in FIG. 2) to thereby rotate the pinion 152 in a clockwise direction, thereby rotating pointer 156 clockwise to indicate the amount of pressure within the tank 15.

As shown in FIG. 1, the bottom housing 106 of the countdown mechanism 20 has a planar surface of sufficiently broad width with the edge thereof terminating in general alignment with the barrel 50 of the air pump 14, and furthermore, the base of housing 106 is generally coextensive with the undersurface of base member 10 to thereby provide a broad base for supporting the apparatus during operation of the air pump 14. The air pump 14 extends generally vertical as does the air tank 15. Similarly, the rocket launching housing 16 in its normal position is generally vertical relative to the air tank 15, the rocket launching housing being positionable by rotation of elbow member 112 about the flanges 122 to vary the angle of launch of rocket 24 therein. This angle of launch is visually ascertainable by means of the protractor member 130 pivotally suspended from the gantry 114.

The valve means 18, in the solid line position shown in FIG. 1, enables air to be transferred from the air pump 14 to the storage tank 15 and to be compressed therein with the pressure being visually indicated by means of the pointer 156. By reciprocation in small increments of the handle 23, the air sounding mechanism or whistle may be actuated and the countdown wheel 96 suitably rotated against the force of contact of the periphery thereof against the friction pad 110. Whenever desired, the handle 23 may be pulled rearwardly a greater distance against the resilient force of tongue 109 against ramp 107 to pass valve member 82 of the valve means 18 into the enlarged diameter portion 72 to thereby permit the compressed air from the air tank 15 to pass through the elbow member 112 to urge against the finned portion of the rocket 24 to thereby launch the same.

With the limiting means formed by ramp 107 and tongue 109, during the countdown, the child can physically discern the point at which tongue 109 engages ramp 107. Although the valve means 18 can be manipulated to launch the rocket 24 at any time during the countdown, the countdown mechanism simulates a countdown prior to launch. With the inclinometer formed by protractor 130, and with a pressure reading from pointer 156, repetitive lob shots can be effected to a predetermined target area in the following manner. With the protractor 130 at a given angle and with the launch being effected at a predetermined pressure, for the next and subsequent launches, the child can bleed off air through the sounding means or whistle 22 until the pressure is at the desired point, at which time the launch can then again be effected with the same angle and same air pressure thus enabling the child to launch the rocket 24 repeatedly into the same target area.

Furthermore, with the rocket pad 128 within the rocket launch housing 16 and with the rocket launch housing 16 having a cruciform configuration, this precludes the insertion of other objects into the rocket launch housing 16 for launching by the device. While there has been shown and described a preferred embodiment, it is to be understood that various other adaptations and modifications may be made within the spirit and scope of the invention.

What is claimed is:

1. A toy projectile launcher comprising:

a main tubular member;

air storage means in fluid communication with said tubular member;

air pump means in fluid communication with said tubular member;

projectile launching means in fluid communication with said tubular member;

manually operable valve means having an elongated bar with first and second enlarged end of generally circular configuration in sealing sliding engagement with said main tubular member, said valve means being operable through first, second and third position; and air-operated sounding means in fluid communication with said tubular member adjacent to first end of said elongated bar, said valve means when in said first position enabling air to pass from said air pump means to said air storage means, when in said second position enabling air from said air storage means to pass to said projectile launching means whereby to launch a toy projectile therein in response to movement of said air, and when in said third position permitting air to pass through said air-operated sounding means.

2. The combination according to claim 1 wherein said second end of said elongated bar is intermediate said air storage means and said rocket launching means.

3. The combination according to claim 2 wherein said main tubular member has an enlarged diameter intermediate said air storage means and said rocket launching means, said second end of said elongated bar being operable to said second position within said enlarged diameter portion for permitting air to pass from the air storage means to said rocket launching means.

4. In a toy projectile launcher, the combination comprising:

a generally rigid main tubular member;

an air storage tank supported by and in fluid communication with said tubular member, said air storage tank being fixedly coupled in generally perpendicular relation with said tubular member;

air pump means coupled to said tubular member in generally perpendicular relation therewith adjacent one end thereof, said air pump means being supported by and in fluid communication with said tubular member;

projectile launching means pivotally coupled to the other end of said tubular member, said projectile launching means being supported by and in fluid communication with said tubular member;

an elongated bar member having first and second valve portions adjacent opposite ends thereof, said bar member being axially movable within said tubular member with said first and second valve portions in sealing sliding engagement within said main tubular member; and manually operable means coupled to said bar member for positioning said bar member within said main tubular member, said bar member and said tubular member being so configured that in one position of said bar member, air from said air pump means is transferred to said air storage tank, and in another position of said bar member air from said air storage tank passes to said projectile launching means whereby to launch a toy projectile therein in response to release of the air from said air storage tank.

5. The combination according to claim 4 wherein said device further includes a toy projectile and said projectile launching means includes a housing having a cross-sectional configuration matingly configured to the launch end of said toy projectile.

6. The combination according to claim 4 wherein said projectile launching means is angularly positionable to vary the angle of launch of the projectile, and said air storage tank includes pressure indicating means for enabling the trajectory of said projectile to be repeated by launching said projectile at a given angle and given pressure.

7. The combination according to claim 4 wherein said bar member is operable to a third position and said tubular member includes air-operated sounding means operable in response to said bar member being in said third position.

8. The combination according to claim 4 wherein said projectile launching means includes an elbow member, one end of said elbow member being pivotally coupled to said tubular member and the other end of said elbow member being configured for receiving the projectile.

9. The combination according to claim 8 wherein said air storage tank is generally intermediate said air pump means and said elbow member.

10. The combination according to claim 9 wherein said air storage tank includes means for indicating the pressure of compressed air therein.

11. The combination according to claim 10 wherein said air storage tank has a first opening in fluid communication with said tubular member and a second opening for receiving said pressure indicating means.

12. The combination according to claim 11 wherein said pressure indicating means includes a diaphragm covering said second opening, a housing securing said diaphragm to said second opening, a pointer member pivotally coupled within said housing and an arm member coacting with said pointer member and said diaphragm for pivoting said pointer member in response to the pressure of air urging against the other side of said diaphragm.

13. The combination according to claim 9 further including a toy projectile which is a rocket having a finned end and said other end of said elbow member is cross-sectionally configured for receiving said finned end in spaced proximate relation therein whereby to provide generally optimum thrust to said toy rocket.

14. The combination according to claim 13 wherein said launching means further includes a gantry member secured to said elbow member adjacent said other end and angle indicating means on said gantry member for indicating the angle of launch of said toy rocket.

* * * * *